United States Patent [19]

Cupp

[11] Patent Number: 4,878,304

[45] Date of Patent: Nov. 7, 1989

[54] GUN GRIP

[75] Inventor: Carl J. Cupp, Hawaiian Gardens, Calif.

[73] Assignee: Pachmayr Ltd., Monrovia, Calif.

[21] Appl. No.: 263,239

[22] Filed: Oct. 27, 1988

[51] Int. Cl.[4] ..... F41C 23/00

[52] U.S. Cl. ..... 42/71.02; 42/75.03

[58] Field of Search ..... 42/59, 71.01, 71.02, 42/75.03

[56] References Cited

U.S. PATENT DOCUMENTS

| | | |
|---|---|---|
| 1,228,506 | 6/1917 | Wesson . |
| 2,308,627 | 1/1943 | Rickenbacher . |
| 3,672,084 | 6/1972 | Pachmayr . |
| 3,815,270 | 6/1974 | Pachmayr . |
| 4,043,066 | 8/1977 | Pachmayr et al. . |
| 4,132,024 | 1/1979 | Pachmayr et al. . |
| 4,148,149 | 4/1979 | Pachmayr et al. . |
| 4,242,824 | 1/1981 | Pachmayr et al. . |
| 4,286,401 | 9/1981 | Pachmayr et al. . |
| 4,359,833 | 11/1982 | Pachmayr et al. . |
| 4,378,651 | 4/1983 | Pachmayr et al. . |
| 4,638,582 | 1/1987 | Farrar . |
| 4,771,562 | 9/1988 | Ruger . |

OTHER PUBLICATIONS

Photograph No. 1 of a gun grip of prior art.
Photograph No. 2 of a gun grip of prior art.

*Primary Examiner*—Deborah L. Kyle
*Assistant Examiner*—Richard W. Wendtland
*Attorney, Agent, or Firm*—William P. Green

[57] ABSTRACT

A pistol grip formed of two complementary grip sections to be received at opposite sides of a handle projection of a gun, and be retained on the handle projection by a fastener extending between the sections. The sections have tubular internal portions extending toward one another and through which the fastener extends, and which are engageable at their inner ends with one another to prevent damage to the sections by overtightening of the fastener. Each section has two wedging surfaces within its interior adapted to engage two coacting surfaces of the handle projection of the gun, with the wedging surfaces of each grip section being disposed at a slight angle with respect to one another for engagement with the handle projection in a manner rigidly retaining the grip sections in fixed positions relative to the handle projection. An additional feature of the invention relates to the provision of interfitting means on the two sections of the grip for retaining the sections in proper relative orientation when preassembled for display purposes separately from a gun.

17 Claims, 4 Drawing Sheets

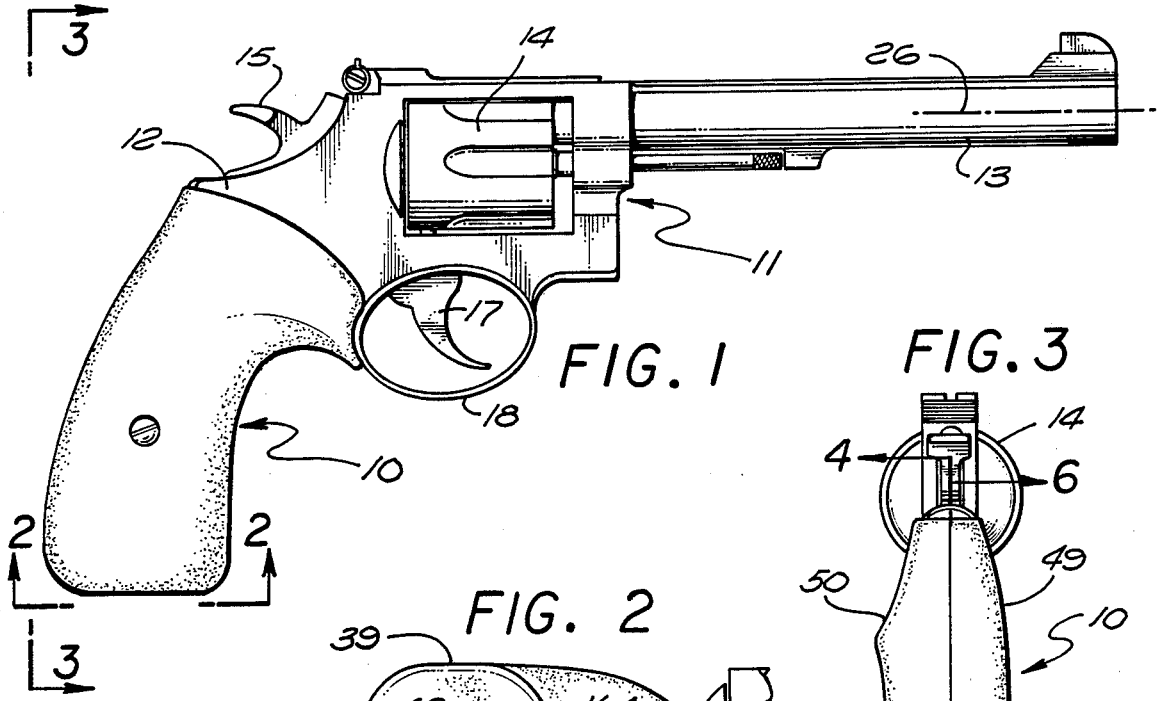
FIG. 1
FIG. 3
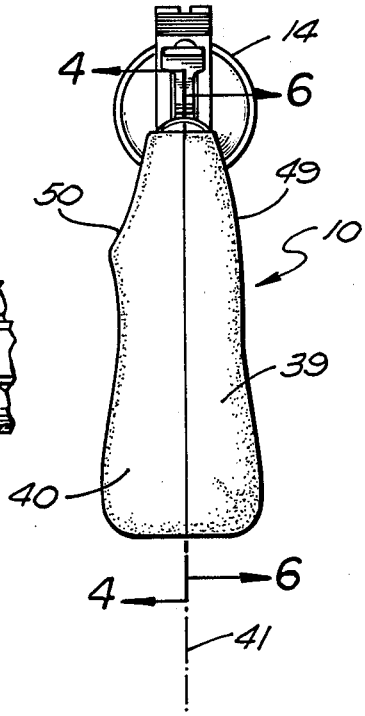
FIG. 2
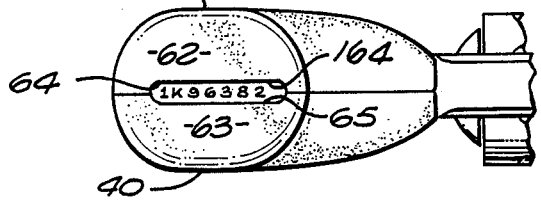
FIG. 4
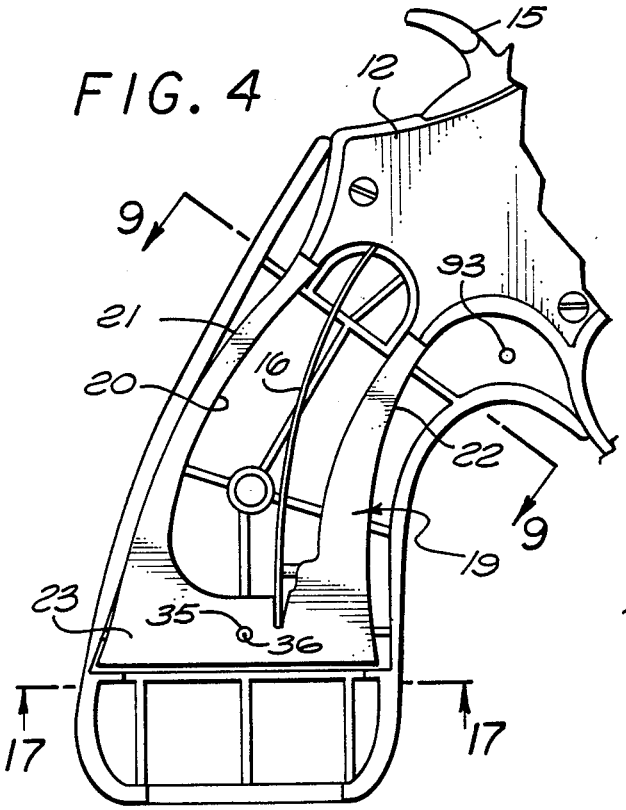
FIG. 4A
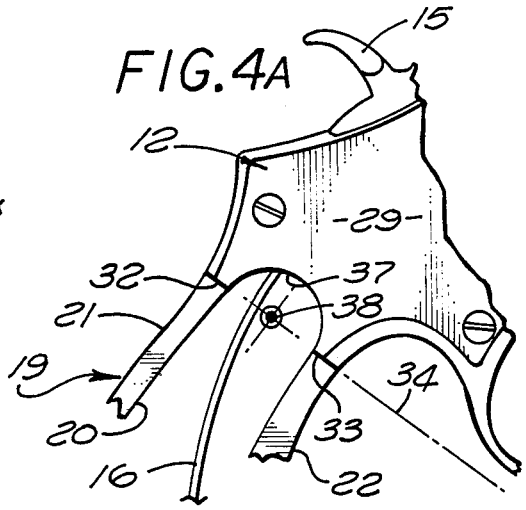

FIG. 5
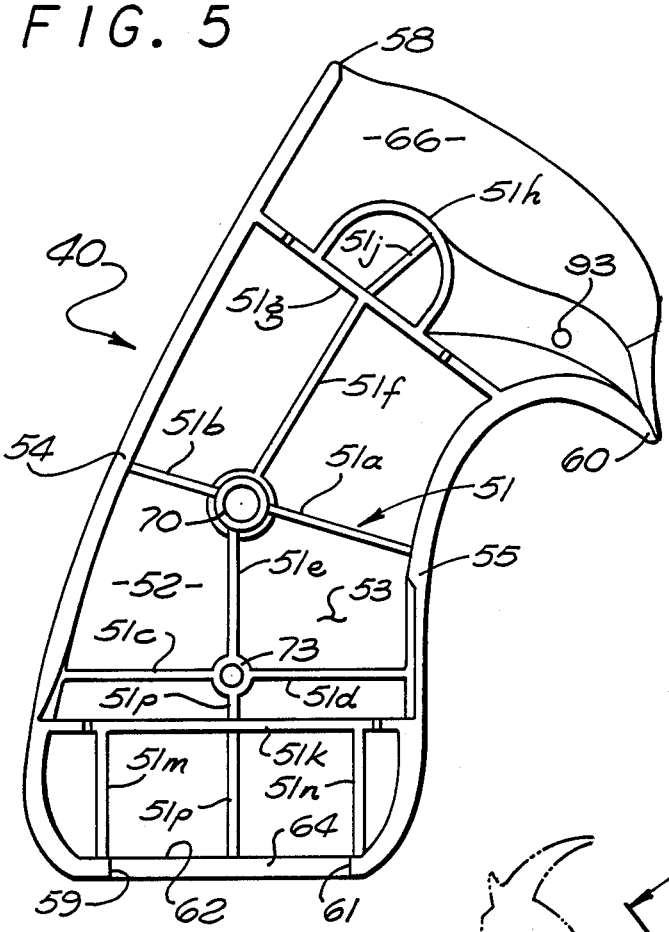
FIG. 8
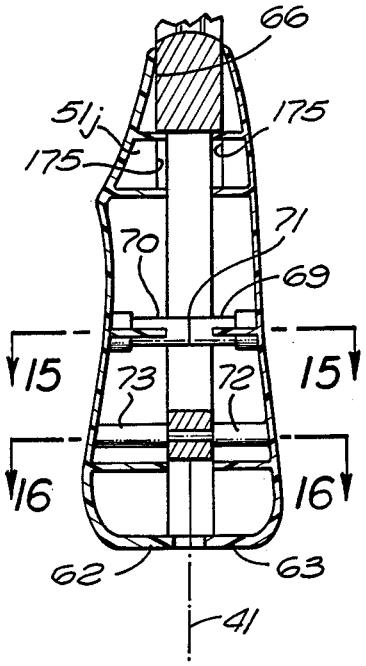
FIG. 6
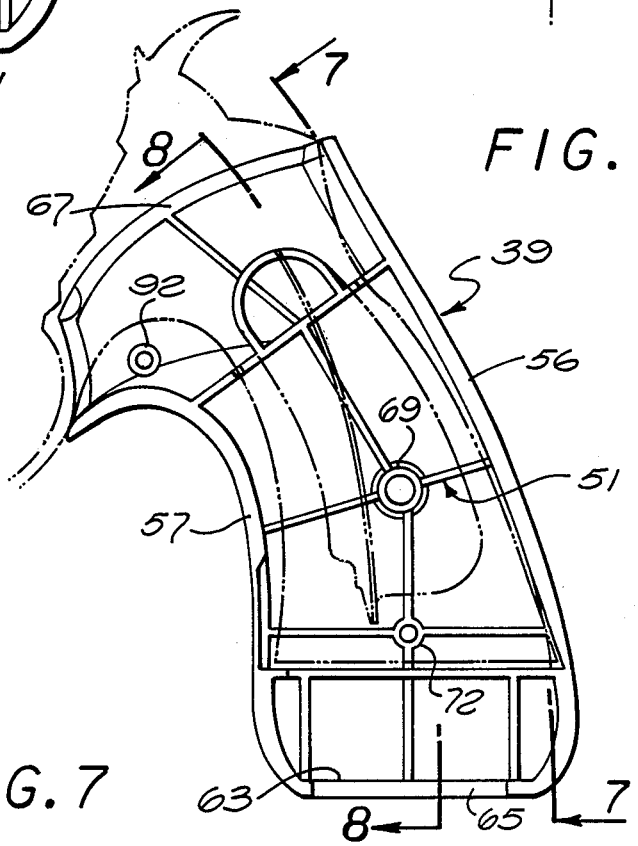
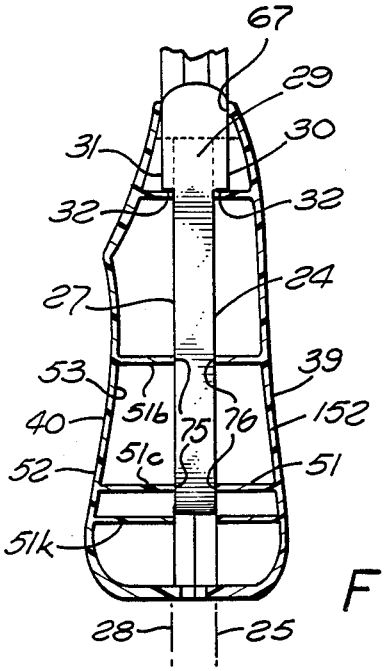
FIG. 7

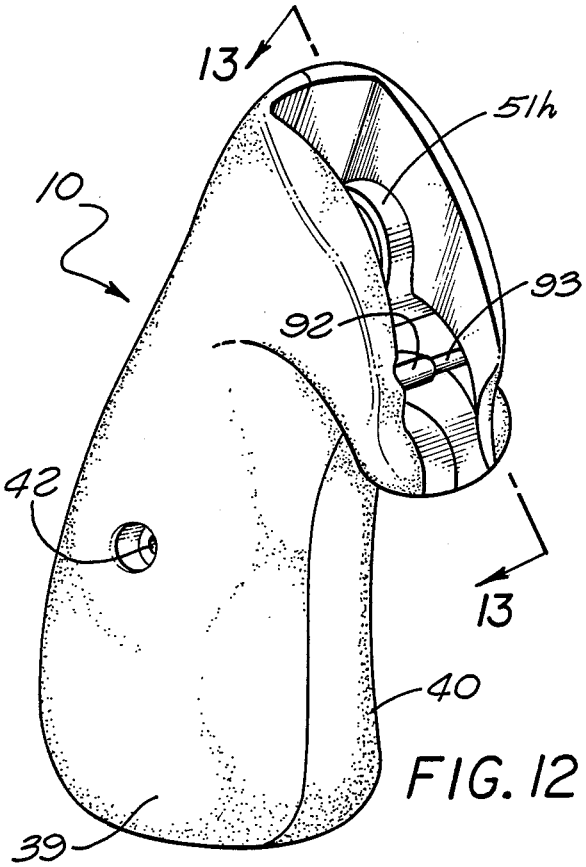
FIG. 12
FIG. 13
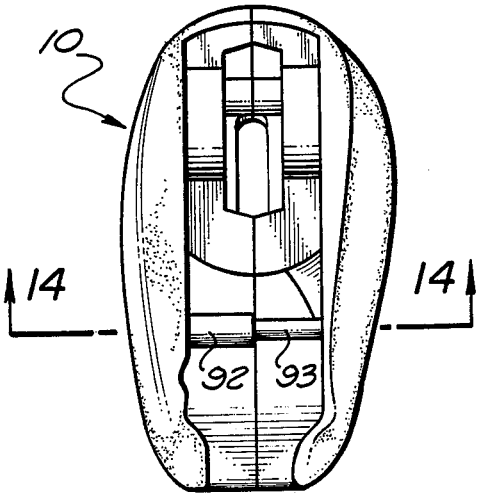
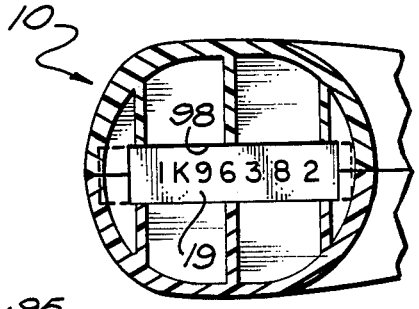
FIG. 17
FIG. 14
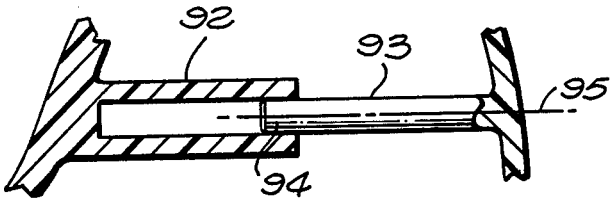
FIG. 15
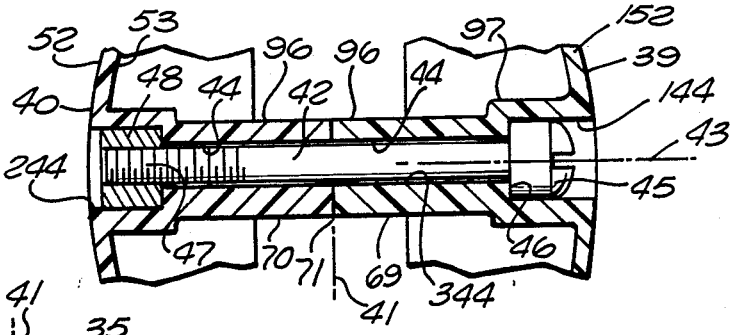
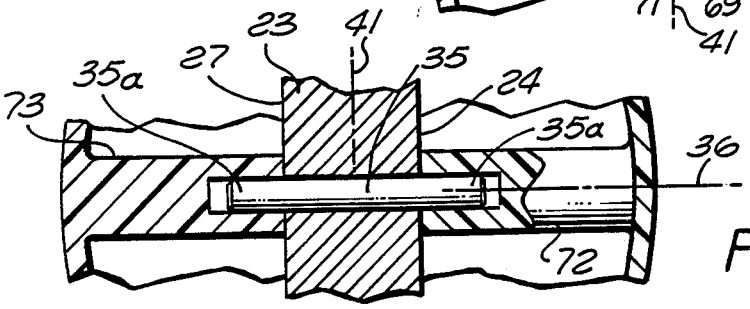
FIG. 16

GUN GRIP

BACKGROUND OF THE INVENTION

This invention relates to improved grips for attachment to the handle of a pistol.

The grips of the invention are of a type including two sections to be received at the right and left sides respectively of a handle projection of a pistol. The sections may be secured to the projection by one or more fasteners, preferably taking the form of a single elongated screw extending between the two sections and through the projection and acting when tightened to pull the right and left grip sections toward one another and against the handle projection of the gun.

SUMMARY OF THE INVENTION

A major purpose of the invention is to provide improvements in the above discussed type of grip enabling the sections to be molded to a hollow configuration minimizing the weight and cost of the grip assembly while at the same time assuring adequate strength of the mounted grip and very effective and positive retention of the grip sections in fixed positions relative to the handle projection of the gun. Structurally, each of the hollow sections of the grip may have an outer wall molded to a shape conveniently grasped by a user's hand, with the interior of each section containing reinforcing ribs projecting inwardly and toward the other section and adapted to engage and bear against opposite side surfaces of the handle projection of the gun. To prevent deformation of or damage to the outer walls of the hollow sections upon tightening of a fastener which secures them together, the sections may have tubular portions through which the fastener extends and which have inner ends engageable with one another in abutting relation limiting movement of the sections relatively together when the fastener is tightened. One or both of these tubular portions may project into an opening or passage extending through the handle projection of the gun.

To attain maximum rigidity in the connection between the grip sections and the handle projection of the gun, at least one of these sections, and preferably each of the sections, may have two wedging surfaces positioned to engage and bear tightly against and be located by two edges of the handle projection when the sections are secured to the gun. These two surfaces are disposed at a slight angle relative to one another, to attain an effective and positive wedging action locking the handle projection of the gun in fixed position in each of the sections. Thus, even though the dimensions of the handle projection may vary slightly for different production guns within a predetermined tolerance range, the projection of any of these guns will effectively contact the wedging surfaces upon tightening of the two grip sections together, with just enough deformation or distortion of the wedging surfaces by the grip projection to allow tight engagement of the projection with those surfaces. The two wedging surfaces of each grip section are prefereably formed within a notched area in one of the reinforcing ribs of that section.

When a grip embodying the invention is to be sold separately from a gun, as an accessory to be attached after sale to a ourchaser's pistol, it is helpful for display and sale purposes to provide the two sections of the grip in preassembled condition, retained together by the fastener which will ultimately be utilized for attaching the sections to the gun. However, if a single fastener is used for retaining the two sections together in preassembled condition, that fastener will not normally by itself hold the two sections in proper complementary orientation with respect to one another, and against rotation relative to one another about the fastener to non-aligned positions. For this reason, the invention provides the two sections at their inner sides with portions which interfit with one another at locations offset from the connecting fastener, to retain the sections in the desired predetermined orientation and prevent rotary movement of one section relative to the other from that position. Preferably, the interfitting portions are telescopically engageable with one another, and include a tube projecting inwardly from one of the sections and a pin projecting from the other section and receivable within the tube.

BRIEF DESCRIPTION OF THE DRAWINGS

The above and other features and objects of the invention will be better understood from the following detailed description of the typical embodiment illustrated in the accompanying drawings in which:

FIG. 1 is a side view of a revolver having a grip embodying the present invention attached to its handle;

FIG. 2 is a bottom plan view of the grip, taken on line 2—2 of FIG. 1;

FIG. 3 is a rear view of the FIG. 1 pistol and grip taken on line 3'3 of FIG. 1;

FIG. 4 is a fragmentary vertical central section taken primarily on line 4—4 of FIG. 3;

FIG. 4A is a fragmentary view similar to a portion of FIG. 4, but with the grip removed from the gun;

FIG. 5 is a view similar to FIG. 4, but enlarged and with the handle projection of the gun removed in order to reveal the inner construction of the left section of half of the grip;

FIG. 6 is a vertical central section taken on line 6—6 of FIG. 3, with the handle projection of the gun shown in broken lines to reveal the inner construction of the right section of the grip;

FIGS. 7 and 8 are fragmentary transverse sections taken on lines 7—7 and 8—8, respectively, of FIG. 6;

FIG. 12 is a perspective view of the two grip sections secured together in preassembled form for display or sale purposes separately from the gun and before attachment of the grip to a gun;

FIG. 13 is an elevational view of the upper portion of the preassembly of FIG. 12, taken on line 13—13 of FIG. 12;

FIG. 14 is an enlarged fragmentary section taken on line 14—14 of FIG. 13;

FIGS. 15 and 16 are enlarged fragmentary horizontal sections taken on lines 15—15 and 16—16, respectively, of FIG. 8; and FIG. 17 is a horizontal section taken on line 17—17 of FIG. 4.

DESCRIPTION OF THE PREFERRED EMBODIMENT

Figure 9:
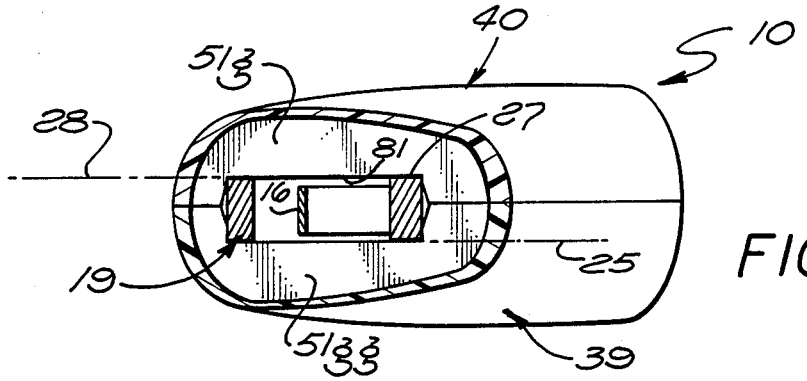
FIG. 9 is a section taken on line 9—9 of FIG. 4.

Referring first to FIG. 1, there is illustrated at 10 in that figure a grip embodying the invention and applied to a conventional pistol 11 of the revolver type. The pistol has a frame 12 carrying a barrel 13 and a cylinder 14 which is rotatable relative to the frame and barrel and carries a series of rounds of ammunition to be fired through the barrel. The usual hammer 15 is urged by a hammer spring 16 (see FIG. 4) to fire the ammunition under the control of a trigger 17 within a trigger loop portion 18 of the frame. The frame 12 has a handle portion 19 (FIG. 4) projecting downwardly and rearwardly and to which grip 10 is connectable. The handle portion or projection 19 may contain a vertically elongated opening 20 extending from one side of the handle to its opposite side and within which hammer spring 16 is mounted. Extending about the defining opening 20, handle projection 19 may be considered as consisting of a rear portion 21 extending downwardly behind the opening, a forward portion 22 extending downwardly in front of the opening, and a bottom portion or cross piece 23 interconnecting the lower ends of portions 21 and 22. All of these portions 21, 22 and 23 of handle projection 19 have right side surfaces 24 (see FIG. 7) which are planar and lie in a common vertical plane 25 extending parallel to and offset to the right side of axis 26 of barrel 13. Similarly, these portions 21, 22 and 23 of handle projection 19 of the gun have left side surfaces 27 which are planar and lie in a common vertical plane 28 parallel to plane 25 and parallel to but offset leftwardly with respect to axis 26 of barrel 13. At the upper ends of portions 21 and 22 of handle projection 19 of the gun, the frame 12 has a widened portion 29 (FIG. 7) with opposite side surfaces 30 and 31 parallel to one another and to surfaces 24 and 27 of the handle projection. At the juncture of portion 21 of the gun handle and the upper widened portion 29 of the frame, the frame forms two co-planar shoulders 32 facing generally downwardly at opposite sides of the handle. Two similar shoulders 33 (FIG. 4A) are formed between the forward portion 22 of the handle and the upper widened portion 29 of the frame. These shoulders 33 lie in the same plane 34 as shoulders 32. The bottom portion 23 of the handle projection 19 carries a locating pin 35 which is externally cylindrical and extends along and is centered about an axis 36 extending transversely of the gun and perpendicular to surfaces 24 and 27 and their planes 25 and 28. Pin 35 is mounted rigidly within an opening in the bottom portion 23 of handle projection 19, and has opposite end portions 35a (FIG. 16) projecting rightwardly of the right side surface 24 of the handle projection and leftwardly of the left side surface 27 of the handle projection. Upwardly beyond plane 34 of shoulders 32 and 33, the widened side portions of the frame form downwardly and rearwardly facing semicircular surfaces 37 centered about an axis 38 extending transversely of the gun and perpendicular to planes 25 and 28 and parallel to axis 36.

The grip 10 embodying the present invention for use on the handle projection 19 of the above described conventional revolver 11 is formed of two similar and complementary right and left sections or halves 39 and 40 received at opposite sides of handle projection 19 of the gun and meeting in a central vertical plane 41 containing axis 26 of barrel 13 and located midway between and parallel to planes 25 and 28 of the opposite side surfaces of handle projection 19. The two sections 39 and 40 are secured together and to the handle of the gun by a screw 42 (FIG. 15) extending along a transverse axis 43 perpendicular to plane 41. Screw 42 extends through aligned passages 44 in the two grip sections 39 and 40, and extends through the opening 20 in handle projection 19 of the gun, with the head 45 of the screw bearing against a shoulder 46 of one of the sections (typically the right section 39), and with the threaded shank 47 of the screw being threadedly connected to a nut 48 embedded within and carried by the other section 40 of the grip.

The two grip sections 39 and 40 have outer surfaces 49 and 50 which are complementary to one another and are curved smoothly and convexly and otherwise shaped to fit the hand of a user and facilitate gripping and firing of the gun. Each of the sections is desirably molded of an essentially rigid resinous plastic material, such as acrylonitrile-butadiene-styrene (ABS), and is hollow and reinforced within its interior by ribs 51 preferably arranged in the pattern illustrated in FIGS. 5 and 6. To first describe the left grip section 40 in detail, this section may be considered as having an outer relatively thin wall 52 whose exterior forms the outer surface 50 of section 40 for engaging a user's hand, and whose inner surface 53 is essentially parallel to and curves in correspondence with outer surface 50. Ribs 51 project inwardly from wall 52 toward the opposite right section 39 of the grip and toward and perpendicular to planes 41, 25 and 28. Extending along the periphery of section 40 and along the edges of its wall 52, section 40 has edge surfaces 54 and 55 (FIG. 5) lying in central vertical plane 41 of the gun and grip and adapted to engage corresponding planar edge surfaces 56 and 57 (FIG. 6) of the right section 39 of the grip. Surface 54 extends between the locations 58 and 59 of FIG. 5, and surface 55 extends between the locations 60 and 61 of that figure. At the bottom of section 40, its outer wall 52 is curved inwardly to form a bottom wall 62 of the grip aligned with and essentially complementary to a corresponding bottom wall 63 of the right section 39 of the grip, with these two bottom walls 62 and 63 being cut away at 64 and 65 to form together an elongated bottom opening 164 (FIG. 2) through which a serial number stamped on the undersurface of bottom portion 23 of gun handle projection 19 is visible.

At its upper end, the left grip section 40 has an inner planar surface 66 (FIGS. 5 and 8) lying in a vertical plane parallel to but offset from the central vertical plane 41 of the gun and grip for engagement with the planar left side surface 31 of upper widened portion 29 of the gun frame.

The right section 39 of the grip is inmost respects very similar to and essentially a mirror image of left section 40. More specifically, the right section is molded of the same essentially rigid resinous plastic material as the left section, and is of generally the same hollow reinforced construction, forming an outer wall 152 curved smoothly and generally convexly to fit a user's hand, with ribs 51 corresponding to those of the left section projecting inwardly from wall 152 and toward and perpendicular to the central vertical plane 41 of the grip. Wall 152 forms the previously mentioned peripheral planar edges 56 and 57 for engaging edges 54 and 55 of the left section of the grip and lying in plane 41 in the assembled condition of the grip on the gun. At its upper end, the right section 39 of the grip has an edge surface 67 lying in a plane offset to the right of and parallel to plane 41 in the assembled condition of the gun and grip, and engaging the right side surface 30 of upper widened portion 29 of the gun frame.

At the location at which screw 42 extends through the two grip sections 39 and 40, these sections have tubular portions 69 and 70 respectively (FIGS. 8 and 15) which are molded integrally with the outer walls 152 and 52 respectively of sections 39 and 40 and project inwardly toward one another. These tubular portions 69 and 70 have aligned cylindrical external surfaces 96 centered about axis 43 and merging with enlarged diameter cylindrical surfaces 97 also centered about axis 43 and located adjacent walls 152 and 52 and about the head 45 of screw 42 and nut 48. Internally, tubular portions 69 and 70 form the previously mentioned passages 44 through which screw 42 extends and which are centered about axis 43 and aligned with one another. Passages 44 have enlarged diameter cylindrical portions 144 and 244 at their outer ends containing the head 45 of screw 42 and nut 48. Between these enlarged portions, passages 44 have aligned smaller diameter cylindrical portions 344 which are dimensioned to receive the shank of screw 42 fairly closely. At their inner ends, tubular portions 69 and 70 have engaging transverse annular end surfaces 71 perpendicular to the axis 43 of the screw and lying in central vertical plane 41 of the gun and grip. The tubular portions 69 and 70 are substantially rigid, and by virtue of their abutting engagement at 71 limit the extent to which the two grip sections can be rightened relatively toward one another by the screw and nut, and thus prevent distortion of the outer walls 152 and 52 and damage to those walls or the remainder of the grip sections by over-tightening of the screw.

At a location beneath the tubular portions 69 and 70, the two grip sections 39 and 40 have two additional tubular portions 72 and 73 molded integrally with their outer walls 152 and 52 respectively and projecting inwardly therefrom and positioned to receive and fit closely about the opposite ends of pin 35 in a manner locating the grip sections in predetermined positions relative to the gun handle projection 19. Tubular portions 72 and 73 are rigid and have annular planar inner surfaces of handle projection 19 to engage those surfaces.

The ribs 51 of the left section 40 of the grip include two ribs 51*a* and 5*b* (FIG. 5) integral with tube 70 and extending in opposite directions therefrom to the front and rear edges 55 and 54 respectively of the left section of the grip. Two similar aligned ribs 51*c* and 51*d* extend in opposite directions from the tubular portion 73 to the opposite edges of the grip section. A rib 51*e* extends essentially vertically between the two tubular portions, and a rib 51*f* extends upwardly from the tubular portion 70 to a rib 51*g* extending at an inclination between edges 54 and 55 at an upper location within the grip section. A semicircular rib 51*h* connected to the upper side of rib 51*g* is positioned to engage the semicircular generally downwardly facing surface 37 formed at the left side of the gun frame at the upper end of its handle projection. This semicircular rib 51*h* may be reinforced by a rib 51*j* formed within it.

At a location spaced beneath the two ribs 51*c* and 51*d*, a horizontal rib 51*k* is provided in section 40, to be received slightly lower than the underside of bottom portion 23 of handle projection 19 of the gun in the assembled condition of the grip on the gun. Additional reinforcing may be provided by two ribs 51*m* and 51*n* extending downwardly from rib 51*k* to the bottom wall 62 of section 40, and a central vertical rib 51*p* extending downwardly from tubular portion 73 to the bottom wall.

The ribs 51 of the right section 39 of grip 10 are arranged in a pattern identical with the various ribs 51*a* through 51*p* of the left section 40 as discussed above, except that the pattern of the ribs of the right section when viewed from the inner side of the section (FIG. 6) is a mirror image of the pattern of the ribs of section 40 as viewed from its inner side (FIG. 5). Thus, when the two sections are assembled together on a gun, each of the ribs of section 39 is directly opposite and aligned with a corresponding one of the ribs of section 40.

As seen in FIG. 7, ribs 51*b* and 51*c* have inner edges 75 which lie in plane 28 and therefore engage the left side surface 27 of handle projection 19 of the gun in the installed condition of the grip. Similarly, the inner edges of ribs 51*a*, 51*d* and 51*e*, and the upper portion of tib 51*p*, lie in plane 28 and abut against the vertical side surface 27 of the gun handle projection, to all assist in transferring forces between the grip and gun and maintaining the grip in fixed position relative to the handle projection 19. Ribs 51*f*, 51*h*, 51*m* and 51*n* and the lower portion of rib 51*p* do not engage projection 19, but may also have their inner edges disposed within plane 28. The ribs of the right section 39 which correspond to ribs 51*a*, 51*b*, 51*c*, 51*d*, and 51*e* have inner edges 76 (FIG. 7) lying in plane 25 for engagement with the right side surface 24 of projection 19, to thus confine the projection tightly between the two grip sections when screw 42 is tightened. The ribs of section 39 corresponding to ribs 51*f*, 51*h*, 51*m*, 51*n* and the lower portion of rib 51*p* of the left section may also have their inner edges disposed within plane 25. Rib 51*j* of the left section of the grip, and the corresponding rib of the right section, may have inner edges 175 (FIG. 8) which are parallel to but spaced a short distance from surfaces 27 and 24 respectively.

Horizontal rib 51*k* of section 40 and the corresponding rib section 39 are cut away as shown in FIG. 17 to form together an elongated rectangular opening 98 which is directly above but may be slightly longer and wider than opening 164 in the bottom wall of the grip to enable viewing of the serial number on the underside of the gun handle. As seen in FIG. 17, the bottom of handle projection 19 of the gun may be slightly larger in horizontal section than the opening 98, so that the periphery of projection 19 can engage downwardly against rib 51*k* and the corresponding rib of section 39 to assist in locating the gun projection in the grip sections.

Figure 10:
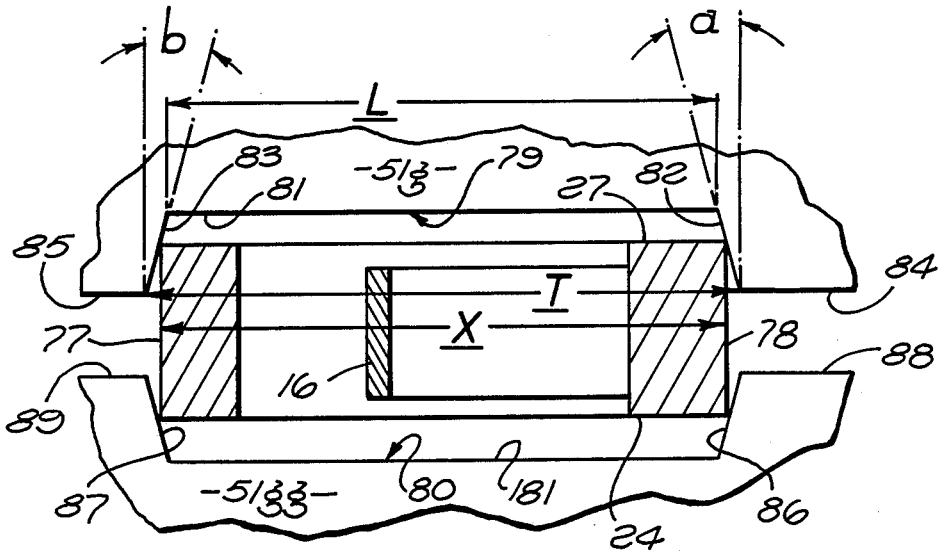
FIG. 10 is an enlarged fragmentary sectional view similar to a portion of FIG. 9, but showing the two right and left sections of the grip separated from one another and as they appear just prior to tightening of the grip sections together and before deformation of the wedge surfaces.
Figure 11:
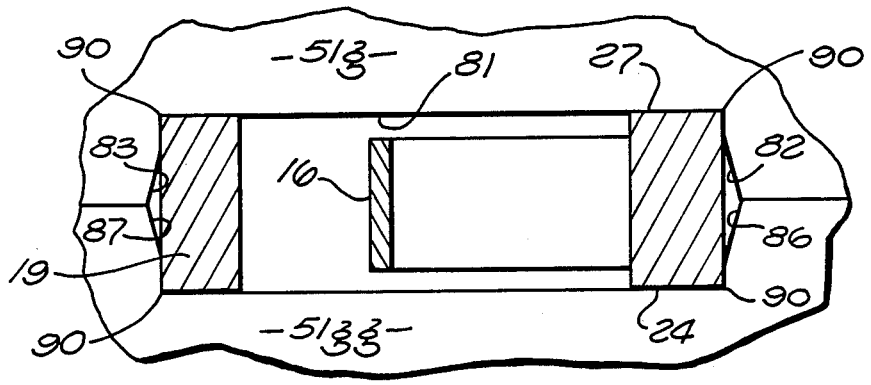
FIG. 11 is a fragmentary section similar to FIG. 10, but showing the rib sections tightened together as in FIG. 9 and after deformation of the wedging surfaces.

With reference now to FIGS. 9 through 11, it is noted that the upper rib 51*g* of section 40 and the corresponding rib 51*gg* of the right section 39 of the grip have awedging engagement with gun handle protection 19 assuring a very rigid connection between the grip sections and gun handle even though the gun handle may vary slightly in front to rear dimension or in width for different guns having the same nominal dimensions. If the maximum dimension X (FIG. 10) of projection 19, between back surface 77 of projection 19 and front surface 78 of the projection, is greater than a predetermined minimum value, the projection 19 engages ribs 51*g* and 51*gg* in a wedging relation causing slight permanent distortion or deformation of the ribs to a condition such as that illustrated in FIGS. 9 and 11 to produce contacting surfaces which exactly match the dimension X of projection 19. For this purpose, ribs 51g and 51gg are formed to have elongated notches or recesses 79 and 80 (FIG. 10) which are complementary and define together a generally rectangular space for receiving the contacted portion of gun handle projection 19. The recess 79 formed in rib 51g is defined in part by an edge 81 which in the FIGS. 9 and 11 assembled condition of the parts lies in the plane 28 of FIG. 7 and thus abuts against side surface 27 of gun projection 19. At opposite ends of this edge 81, rib 51g has edges 82 and 83 which extend almost perpendicular to edge 81, but which flare gradually apart at small angles a and b with respect to the true perpendicular as they advance toward the other section of the grip. Angles a and b may typically be between about 4 and 15 degrees, preferably about 7.5 degrees. The preferred angularity is somewhat exagerated in the drawings for illustrative purposes. At the extremities of edges 82 and 83, rib 51g has two aligned edges 84 and 85 which in the assembled condition of the parts lie in central vertical plane 41 of the gun. The recess 80 in rib 51gg is directly opposite and dimensioned in correspondence with recess 79 of rib 51g, and is a mirror image thereof, with edge 181 parallel to edge 81 and adapted to lie in plane 25 and engage surface 24 of the gin in the installed condition of the grip. Wedging edges 86 and 87 diverge away from one another as they advance toward section 39 of the grip, with the angles of divergence corresponding to angles a and b of edges 82 and 83. Edges 88 and 89 of rib 51gg contact edges 84 and 85 of rib 51g and lie in plane 41 in the assembled condition of the parts. The dimension L between wedging edges 82 and 83 at their closest point (and between edges 86 and 87 at their closest point) is slightly less than the dimension X between the front and rear surfaces 78 and 77 of gun projection 19 at the location of ribs 51g and 51gg, while the dimension T between the widest portions of these wedging surfaces is slightly greater than the dimension X.

In assembling grip sections 39 and 40 on a gun, the grip sections are first placed in proper position at opposite sides of projection 19, and screw 42 is then inserted through the grip sections into engagement with nut 48, and tightened to force grip sections 39 and 40 together and against theprojection 19. As the grip sections reach the point illustrated in FIG. 10, at which wedge surfaces 82, 83, 86 and 87 first contact the corresponding corners of handle projection 19, the wedge surfaces tend to resist further tightening of the grip sections. Sufficient force is applied against this resistance to continue movement of the grip sections together and ultimately to the position illustrated in FIG. 11, with the corners 90 of projection 19 cutting into the wedge surfaces 82, 83, 86 and 87, and deforming or gouging them out to the condition illustrated in FIG. 11. Thus, when the parts reach the FIG. 11 condition, a very rigid connection between projection 19 and the deformed wedging surfaces of projection 19 of the gun is attained. This wedging action enables grips formed in accordance with the present invention to be utilized effectively on guns in which the handle dimension X may vary slightly, so long as dimension X is at least as great as the minimum spacing L between the wedge surface and not greater than the maximum spacing T.

During display and handling of the grip prior to and at the time of sale, it is desirable that the two sections 39 and 40 of the grip be secured together by screw 42 in the condition illustrated in FIG. 12. In order to retain these two sections, separate from the gun, against pivotal movement relative to one another about the axis of screw 42, the sections are provided with interfitting portions at a location offset from the axis of the screw. These interfitting portions preferably include a tubular portion 92 (FIG. 13 and 14) formed integrally with the outer wall of one of the sections, and a pin 93 formed integrally with the outer wall of the other section and having an inner end 94 telescopically received and closely confined within tube 92 in the FIG. 14 assembled condition of the two grip sections. These telescopic portions 92 and 93 extend along an axis 95 which is parallel to the axis 43 of the screw, and is perpendicular to plane 41, and may be located near the upper ends of the sections at a point at which they will not interfere with any mechanism of the gun, and will extend through an unoccupied space in the gun.

While a certain specific embodiment of the present invention has been disclosed as typical, the invention is of course not limited to this particular form, but rather is applicable broadly to all such variations as fall within the scope of the appended claims.

I claim:

1. For use with a pistol having a handle projection, a grip comprising:

right and left grip sections to be received at opposite sides respectively of said handle projection;

at least one of said sections having two surfaces which extend generally transversely of said handle projection and which face in generally opposite directions and are positioned to engage two surfaces respectively of said projection to locate said one section relative to the projection;

said two surfaces of said one grip section being disposed at a slight wedging angle with respect to one another to wedge tightly against said surfaces of the projection upon movement of said one section transversely of the pistol onto said handle projection.

2. A grip as recited in claim 1, in which said two surfaces of said one section are spaced apart in generally a front to rear direction and face generally toward one another and converge progressively toward one another as they advance away from the other section to wedge tightly against opposite front and rear edges respectively of said projection.

3. A grip as recited in claim 2, in which said one section has a third surface extending between said two converging surfaces and engageable with an outer side surface of said projection upon assembly of the grip on the projection.

4. The combination including a pistol having a handle projection, and a grip as recited in claim 1 attached to the projection with said surfaces of the said one section wedged against two surfaces of the projection.

5. The combination including a pistol having a handle projection, and a grip as recited in claim 3, attached to the projection with said surfaces of said one section wedged against front and rear edges of the projection, and with said third surface engaging an outer surface of the projection.

6. For use with a pistol having a handle projection, a grip comprising:

right and left grip sections to be received and retained at opposite sides respectively of said handle projection;

at least one of said sections being hollow and having an outer wall and having rib means projecting inwardly from said outer wall toward the other section;

said rib means having two edges which extend generally transversely of said handle projection and which face in generally opposite directions and are positioned to engage two surfaces respectively of said projection and thereby locate said one section relative to the projection;

said two edges of said rib means being disposed at a slight wedging angle to one another wedge tightly against said surfaces of the projection upon movement of said one section transversely of the pistol onto said handle projection.

7. A grip as recited in claim 6, in which said two edges of the rib means face generally toward one another and said one section form a third edge of the rib means extending between said two edges of the rib means facing toward the other section and adapted to engage an outer surface of said projection upon assembly of the grip on the projection.

8. A grip as recited in claim 6, in which said rib means include a wedging rib which is cut away to receive said projection and which forms said two edges of the rib means at locations to engage front and rear edges respectively of the projection and which has a third edge extending between said two first mentioned edges of the rib means and facing inwardly toward the other section to engage an outer surface of the projection upon assembly of the grip on the projection.

9. A grip as recited in claim 6, in which said edges of said rib means are adapted to be slightly deformed when wedged against said projection.

10. For use with a pistol having a frame with a handle projection extending downwardly at the rear thereof, a grip comprising:

hollow complementary right and left grip sections to be received at opposite sides respectively of said handle projection;

means for holding said sections on the projection;

said sections having outer walls of externally convex and internally concave curvature forming opposed inner recesses in the sections;

said sections containing reinforcing ribs projecting inwardly from said outer walls of the sections and at least some of which have inner edges for engaging opposite side surfaces of said projection;

said ribs of each section including a wedging rib extending in a generally front to rear direction and which is cut away to receive said projection and to define two edges of the wedging rib spaced apart and facing one another for engaging opposite front and rear edges of said projection in locating relation, said two spaced edges of said wedging rib of each of said sections converging progressivly toward one another as they advance outwardly away from the other section and being adapted to wedge tightly against said front and read edges of the projection upon assembly of the grip on the projection.

11. A grip as recited in claim 10, in which said wedging rib of each of said sections has a third edge extending between said two spaced converging edges and adapted for engagement with an outer side surface of said projection upon assembly of the grip on the projection.

12. A grip as recited in claim 11, in which said sections have aligned tubular portions projecting inwardly from said outer walls of the two sections and at least one of which projects into a transverse opening in said handle projection of the pistol, there being a fastener adapted to extend through said tubular portions of the sections and through said opening in said projection to secure said sections together and to said projection, said tubular portions having inner ends engageable with one another to limit movement of the tubular portions relatively together and thereby resist damaging distortion of said outer walls upon tightening of said fastener.

13. A grip as recited in claim 10, in which said sections have aligned tubular portions projecting inwardly from said outer walls of the two sections, there being a fastener adapted to extend through said tubular portions of the sections to secure said sections together and to said projection, said tubular portions having inner ends engageable with one another to limit movement of the tubular portions relatively together and thereby resist damaging distortion of said outer walls upon tightening of said fastener.

14. The combination comprising a pistol having a handle projection, and a grip as recited in claim 10 attached to said projection, with said edges of said wedging rib of each section being wedged tightly against front and rear edges of the projection.

15. The combination including a pistol having a handle projection, and a grip as recited in claim 12 attached to said projection, with said spaced converging edges of said wedging rib of each section being wedged against front and rear edges of said projection, and with said third edge of the wedging rib of each section engaging an outer surface of the projection.

16. For use with a pistol having a handle projection, a grip comprising:

right and left grip sections to be received at opposite sides respectively of said handle projection;

said sections having tubular portions projecting inwardly from the two sections respectively and toward one another;

a fastener to extend through said tubular portions of the sections for securing said sections together and to said projection;

said tubular portions of the two sections having inner ends engageable with one another to limit movement of the tubular portions relatively together and thereby resist damaging distortion of said sections upon tightening of said fastener;

said sections having portions which interfit at a location offset from said tubular portions to retain the sections against rotation relative to one another about said fastener from a predetermined complementary orientation when assembled for sale or display without said handle projection therebetween;

said interfitting portions including a tube projecting from one of said sections at alocation offset from said tubular portions of the sections, and apin projecting from the other section and receivable telescopically in said tube;

said sections being hollow and having outer walls from which said tubular portions and said tube and said pin project inwardly, and having ribs projecting inwardly from said outer walls for engagement with outer surfaces of said projection;

at least one of said sections having two surfaces positioned to engage two edges respectively of said projection and locate said one section relative to the projection, with said two surfaces of said one section being disposed at a wedging angle to one another to wedge tightly against said edges of the projection upon movement of said one section onto said handle projection.

17. The combination comprising a pistol having a handle projection, and a grip as recited in claim 16 attached to said projection by a fastener extending through said tubular portions, with said inner ends of the tubular portions in engagement with one another.

* * * * *